United States Patent [19]

Haag

[11] Patent Number: 4,552,796

[45] Date of Patent: Nov. 12, 1985

[54] COMPOSITE PRODUCT HAVING A LOW-POROSITY SUPPORT LAYER

[75] Inventor: Laurent Haag, Wiltz, Luxembourg

[73] Assignee: Eurofloor S.A., Luxembourg

[21] Appl. No.: 664,533

[22] Filed: Oct. 25, 1984

Related U.S. Application Data

[62] Division of Ser. No. 413,746, Sep. 1, 1982, Pat. No. 4,492,606.

[30] Foreign Application Priority Data

Sep. 2, 1981 [LU] Luxembourg ..... 83602

[51] Int. Cl.[4] ..... B32B 3/24

[52] U.S. Cl. ..... 428/140; 428/318.6; 428/220; 428/339

[58] Field of Search ..... 428/140, 318.6, 220, 428/339; 156/79, 252, 322

[56] References Cited

U.S. PATENT DOCUMENTS

| | | | |
|---|---|---|---|
| 1,292,705 | 1/1919 | Cheney | 428/140 |
| 4,016,318 | 4/1977 | Digioia et al. | 428/95 |

FOREIGN PATENT DOCUMENTS

| | | |
|---|---|---|
| 420644 | 6/1935 | United Kingdom . |
| 1543472 | 4/1979 | United Kingdom . |

*Primary Examiner*—Alexander S. Thomas
*Attorney, Agent, or Firm*—Fishman & Dionne

[57] ABSTRACT

A composite floor covering product comprising a layer of low-porosity support material, such as asbestos, is produced by a process comprising the steps of (a) perforating a low-porosity support material, (b) coating a compact PVC plastisol precoat onto at least one face of the perforated low-porosity support, and (c) finishing the product with various coatings and decorations, comprising at least one fusing or gelling stage.

2 Claims, 2 Drawing Figures

COMPOSITE PRODUCT HAVING A LOW-POROSITY SUPPORT LAYER

This application is a division of application Ser. No. 413,746, filed Sept. 1, 1982, now U.S. Pat. No. 4,492,606.

BACKGROUND OF THE INVENTION

This invention relates to an improved composite product having a low-porosity support layer and the method of manufacture thereof. More particularly, this invention relates to an improved composite product and an improved process for the manufacture thereof comprising a layer or substrate of a low-porosity material, such as asbestos, and intended to serve as a floor covering product.

In particular, this invention improves the bond strength and delaminating resistance of a sheet of a low-porosity material, such as asbestos, present as in internal layer in a floor covering product.

In the floor covering market a certain number of products are known and available which include a layer, generally of asbestos, which serves as a support for various PVC plastisol coatings and ink printings combined in a known manner to obtain a finished product. If this support layer is sandwiched between two plasticised PVC sheets (as is typical in construction of this type), it has been found that the bond strength between the plasticised PVC sheets and the support layer is poor in the contact zone between those sheets. It has been found that it is possible to completely delaminate products of this type at low force or stress levels. Tests have shown that a force as low as 0.08 kg($1.73\times10^{-3}$W) per cm. width of material is sufficient to effect delamination in these prior art products. This delamination presents a serious problem and drawback to the utility of these floor covering products. Experience shows that bond strengths of at least ten times greater than are now generally available (i.e., on the order of 1 kg/cm) are required to insure that the composite material stays together during handling, in particular during laying or installation on floors, and remains together for long periods of use and service.

SUMMARY OF THE INVENTION

The present invention produces an improved composite product, particularly a flooring covering product, having significantly improved bond strength via a new process of manufacture which results in a floor covering product having improved properties.

In accordance with the broadest aspect of the present invention, the composite product is made by a process which comprises at least the following general steps:

(a) Perforating a nonporous support material,
(b) Coating a compact PVC plastisol precoat onto at least one surface of the perforated nonporous support layer, and
(c) finishing the product with various coatings and decorations, as known in the art, with at least one fusing or gelling stage.

This finishing process can, in particular, include:

(a) gelling the PVC plastisol precoat at a temperature compatible with the nature of the plastic employed,
(b) applying a foamable coating and decoration on to the face of the support which has received the plastisol precoat, and
(c) expanding or curing the foamable coating.

While the composite products to which the present invention is applicable typically employ an asbestos sheet as the internal support or substrate layer, various other types of support may be found in these composite materials, which supports by reason of the low-porosity characteristics do not permit good chemical and/or physical anchoring or bonding of the various coating layers applied to the support layer. The present invention overcomes this problem by perforating the nonporous support layer so as to achieve, in effect, a riveting of the coating layers across the nonporous support layer to fix or anchor the nonporous support layer to the coating layers.

BRIEF DESCRIPTION OF THE DRAWINGS

Referring now to the drawings, wherein like elements are number alike in the two figures.

DESCRIPTION OF THE PREFERRED EMBODIMENTS

Figure 1:
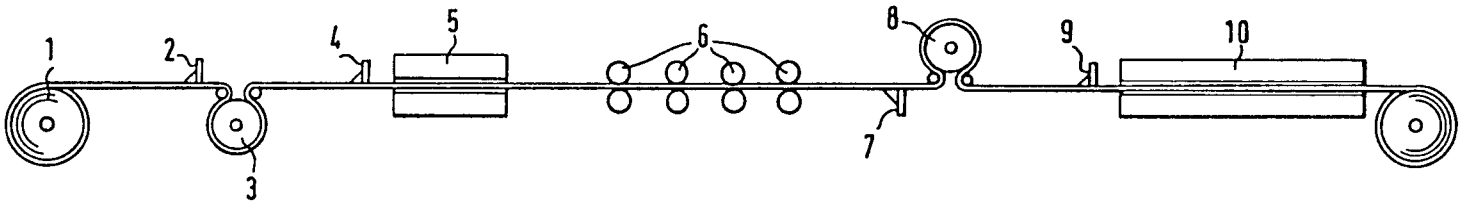
FIG. 1 is a schematic illustration of the manufacturing sequence, and the equipment used therein, to effect the process and produce the end product of the present invention.

The present invention produces an improved composite product, particularly a floor covering product, having significanly improved bond strength via a new process of manufacture which results in a floor covering product having improved properties.

In accordance with the broadest aspects of the present invention, the composite product is made by a process which comprises at least the following general steps:

(a) Perforating a nonporous support material,
(b) Coating a compact PVC plastisol precoat onto at least one surface of the perforated nonporous support layer, and
(c) finishing the product with various coatings and decorations, as known in the art, with at least one fusing or gelling stage.

This finishing process can, in particular, include:

(a) gelling the PVC plastisol precoat at a temperature compatible with the nature of the plastic employed,
(b) applying a foamable coating and decoration on to the face of the support which has received the plastisol precoat, and
(c) expanding or curing the foamable coating.

Typically the composite products of the present invention will employ an asbestos sheet as the internal support layer; but various other types of supports or substrates, which by reason of their low-porosity characteristics do not permit good chemical and/or physical anchoring or bonding of the various coating layers to the support layer may also be used. By way of example, possible support layers in addition to asbestos include known asbestos substitutes (e.g. rock wool), paper sheet, cardboard, other cellulosic materials, and felts of synthetic fibers based on polyolefines. In addition, metal foils, (e.g. copper or aluminimun) may also be employed as the support or substrate material, these foils materials having the additional advantage of imparting desirable properties from a thermal standpoint.

As indicated above, the support layer of nonporous or low-porosity material is perforated to provide anchoring or riveting sites for the layers coated on the support sheet. The perforations will preferrably be in a grid array, and the number, diameter and size of the perforations in the grid pattern will depend on the nature and thickness of the support material. For an asbestos substrate layer, perforations of from 0.5 to 3 mm diameter, arranged in a unit grid of from 2 to 20 mm on each side (i.e., one perforation per unit of grid) have been found to be suitable and preferred. These perforations can be produced by any mechanical means, such as by dies and punches, by means of spiked drums or by any other suitable apparatus. By way of illustration of the improved results which have been achieved in accordance with the present invention, bond strenghts of 1.1 kg/cm where obtained using a 0.6 mm thick asbestos substrate sheet with perforations of 1.5 mm diameter in a unit grid of 8 mm on each side (i.e., one perforation of 1.5 mm diameter in each square section of 8 by 8 mm of the asbestos sheet). Also, a bond strength of 2.6 kg/cm was obtained for that same material and perforation dimension using a grid dimension of 4 mm on each side; i.e., one perforation of 1.5 mm diameter in each square unit of asbestos measuring 4 mm on each side. These bond strengths exceed, by a wide margin, the minimum value of 1 kg/cm which is considered necessary to have an acceptable product.

In the preferred embodiment of the present invention, a compact (i.e., nonexpandable or nonfoamable) plastisol precoat is coated onto both faces (i.e., front and back) of the perforated support. This coating on both sides of the perforated support can be effected successively on each side or simultaneously on both sides. The plastisol precoat is preferably applied in a thickness ranging from 0.005 to 3 mm and most preferably on the order of 0.15 mm onto both faces of the support. The perforations in the support are thus essentially filled up and the plastisol coatings on the two faces of the low-porosity support material join through the perforations and are then anchored to each other through the perforations. The compact PVC plastisol percoat may be applied to the substrate material by any well know technique, such as by the use of doctor blades, an air knife technique, or the so-called "reverse roll" technique.

The parameters for chosing suitable PVC plastisol materials for use in accordance with the present invention are relatively simple. The compact plastisol should have a nonfoamable formulation; the base of the formulation is PVC of the emulsion type; and the nature and the content of the plasticiser must be such as to give sufficient tensile strength in the final product. It has been found that the use of highly plasticised and filled plastisol formulations typically used in preparation of glass web material are not suitable because they do not achieve bond strengths greater than 0.5 kg/cm regardless of the number of perforations per unit area of the support.

As indicated above, the plastisol coat or coatings on the perforated substrates are gelled; and a foamable coating will also be employed in the finishing process of the floor covering product. Gelling will be carried out in the normal temperature range on the order of from 120° C. to 150° C. Expansion or curing of the foamable coating and final fusing are carried out at a higher temperature which will be determined by the formulation of the foamable composition, temperatures on the order of about 200° C. being typical. The gelling can be effected by any known technique, such as by use of a heated drum, in an oven or by radiant heat.

Also as indicated above, in order to produce a decorated floor covering as a finished product it will be necessary to interpose, among the various stages of production, one or more known steps or stages to effect a decoration for the finished product. These decorating steps are known and conventional in the art.

By way of general illustration, the following steps may be employed in carrying out the present invention:

(a) perforating a layer of support material which is nonporous or of low-porosity,
(b) coating a compact PVC plastisol precoat onto one or both faces of the perforated support,
(c) gelling the plastisol precoat on a heated drum at 145° C.,
(d) applying a compact plastisol back coating (on the reverse side of the perforated substrate if only side has previously been coated),
(e) gelling the back coat on the drum at 145° C.,
(f) applying a foamable coating to one face of the material,
(g) effecting a printing or other decorative process, as desired, to the foamable coating,
(h) applying a wear-resistant layer to the foamable coating, and
(i) expanding or curing, for example for three (3) minutes at 200° C. in an oven.

Figure 2:
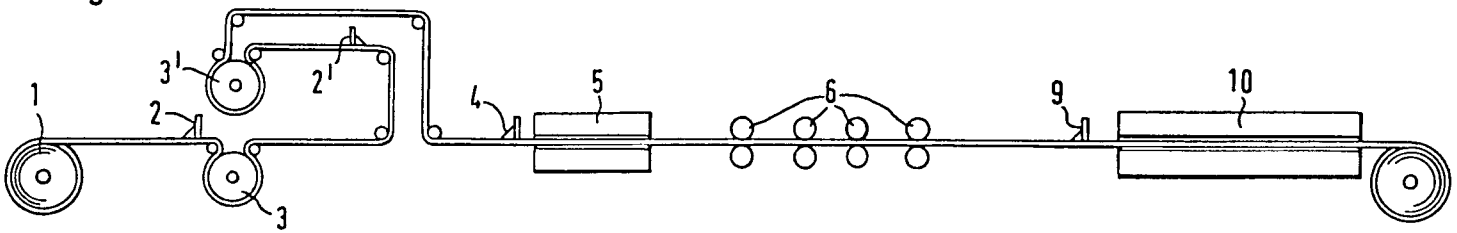
FIG. 2 is a view similar to FIG. 1 showing a modification.

FIGS. 1 and 2 illustration typical and practical embodiments of the present invention; but it will be understood that numerous other working configurations are also possible within the spirit and scope of the invention.

Referring to FIG. 1, a perforated support or substrate material 1, such as asbestos, is provides in the form of a roll or coil. A compact (non-foamable) PVC plastisol precoat 2 is applied to the perforated support or substrate 1, and the plastisol precoat is gelled on a heated drum 3. A second PVC plastisol 4 is then applied to the gelled precoat, this second plastisol 4 being foamable. The second plastisol is then gelled in oven 5. A four color gravure printing is then effected on the foamable layer at rolls 6. A third layer of compact, (nonfoamable) plastisol 7 is then applied to the back or reverse side of the support 1, followed by gelling on a heated drum 8. Then, a fourth and last coating of an unfilled and transparent plastisol 9 is applied over the foamable and decorated plastisol to serve as a wear-resistant layer. The composite assembly is then expanded, cured and fused completely in oven 10.

Referring to FIG. 2, the perforated support or substrate material 1, such as asbestos, is provides in the form of a roll or coil. A first compact, (non-foamable) PVC plastisol precoat 2 is applied to the front or upper surface of the perforated support or substrate 1, and the plastisol precoat is gelled on a heated drum 3. A second layer of PVC plastisol precoat 2' is applied to the back surface of substrate 1, and the second precoat layer is gelled on a heated drum 3'. A second PVC plastisol 4 is then applied to the gelled precoat on the upper surface of substrate 1, this second plastisol 4 being foamable. The second plastisol is then gelled in oven 5. A four color gravure printing is then effected at rolls 6. Then, a fourth and last coating of an unfilled and transparent plastisol 9 is applied over the foamable and decorated plastisol to serve as a wear-resistant layer. The composite assembly is then expanded, cured and fused completely in oven 10.

As will be recognized and understood by those skilled in the art, the present invention makes it possible to produce floor coverings from nonporous support materials or support materials of low-porosity, such as asbestos, certain cellulosic materials or metal foils, which by their nature are unreceptive to chemical anchoring agents. The product and process of the present invention results in a composite material of high bond strengths which resist delamination and are particularly effective and suitable for use as decorative floor coverings.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A composite floor covering product including:

a support substrate of low-porosity material;

a plurality of perforations in said substrate wherein said low-porosity support has perforations ranging in diameter from about 0.5 to about 3 mm, arranged in unit grid segments of from about 2 to about 20 mm in length on each side;

a coating of compact plastisol precoat on both surfaces of said perforated support substrate and extending into said perforations wherein said plastisol essentially fills said perforations, and wherein said coatings are joined and locked together through said perforations; and a foamed plastic coating over said plastisol precoat.

2. A composite floor covering as in claim 1 wherein: said compact plastisol precoat is from about 0.005 to about 3 mm thick.

* * * * *